US009375939B2

(12) United States Patent
Aoki

(10) Patent No.: US 9,375,939 B2
(45) Date of Patent: Jun. 28, 2016

(54) LIQUID HOUSING CONTAINER RECYCLING METHOD, AND LIQUID HOUSING CONTAINER

(71) Applicant: SEIKO EPSON CORPORATION, Tokyo (JP)

(72) Inventor: Yuji Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/510,389

(22) Filed: Oct. 9, 2014

(65) Prior Publication Data

US 2015/0109383 A1 Apr. 23, 2015

(30) Foreign Application Priority Data

Oct. 22, 2013 (JP) ..... 2013-218955

(51) Int. Cl.
*B41J 2/175* (2006.01)

(52) U.S. Cl.
CPC ..... *B41J 2/17523* (2013.01); *B41J 2/17503* (2013.01); *B41J 2/17506* (2013.01); *B41J 2/17509* (2013.01); *B41J 2/17513* (2013.01); *B41J 2/17559* (2013.01); *B41J 2/17566* (2013.01)

(58) Field of Classification Search
CPC ..... B41J 2/17503; B41J 2/17506; B41J 2/17509; B41J 2/17513; B41J 2/17523; B41J 2/17553; B41J 2/17566; B41J 2/17573; B41J 2002/17516
USPC ..... 347/85, 86, 108
See application file for complete search history.

(56) References Cited

U.S. PATENT DOCUMENTS

| | | | | |
|---|---|---|---|---|
| 5,721,576 | A * | 2/1998 | Barinaga | 347/85 |
| 5,950,403 | A * | 9/1999 | Yamaguchi et al. | 53/434 |
| 6,676,251 | B1 * | 1/2004 | Kamp | 347/86 |
| 6,843,558 | B2 * | 1/2005 | Seino | 347/85 |
| 7,287,843 | B2 * | 10/2007 | Muranaka et al. | 347/86 |
| 7,384,133 | B2 * | 6/2008 | Ishizawa et al. | 347/86 |
| 8,454,143 | B2 * | 6/2013 | Takeuchi | 347/86 |

FOREIGN PATENT DOCUMENTS

JP 2004-358802 A 12/2004

* cited by examiner

*Primary Examiner* — Anh T. N. Vo
(74) *Attorney, Agent, or Firm* — Global IP Counselors, LLP

(57) ABSTRACT

The liquid housing container recycling method includes removing a second case member from a first case member, taking out a liquid housing body from inside of the first case member, forming on the liquid housing body an opening part that communicates with inside of a liquid housing unit, injecting into the inside of the liquid housing unit from the opening part that is formed liquid of a volume that is smaller than an initially housed volume when the liquid is initially injected and housed in the liquid housing unit of the liquid housing body in a state of being housed inside the case member, sealing the opening part of the liquid housing body, housing inside the first case member the liquid housing body for which the opening part is sealed, and attaching the second case member to the first case member.

11 Claims, 9 Drawing Sheets

LIQUID HOUSING CONTAINER RECYCLING METHOD, AND LIQUID HOUSING CONTAINER

CROSS-REFERENCE TO RELATED APPLICATIONS

This application claims priority to Japanese Patent Application No. 2013-218955 filed on Oct. 22, 2013. The entire disclosure of Japanese Patent Application No. 2013-218955 is hereby incorporated herein by reference.

BACKGROUND

1. Technical Field

The present invention relates to a recycling method for a liquid housing container capable of housing liquid, and to a liquid housing container.

2. Related Art

From the past, inkjet printers have been known as an example of a liquid consuming device that sprays and consumes a liquid (ink or the like). A liquid housing container (ink cartridge or the like) with a liquid housing body (ink pack or the like) having a liquid housing unit in which liquid is housed equipped inside a case member is mounted in this kind of printer, and liquid is supplied from the liquid housing container mounted in this way.

A supply port that flows out the liquid housed in the liquid housing unit is provided on a liquid housing body of this kind of liquid housing container. In a state with the liquid housing body housed inside the liquid housing container, this supply port is exposed inside the case member. Then, when the liquid housing container is mounted in a mounting unit of the printer, this supply port is connected to be able to supply liquid to a liquid supply tube (e.g. a supply needle) provided in the printer.

Also, with this kind of liquid housing container, there have been proposals to recycle liquid housing containers for which supplying of liquid to the printer has become difficult due to the housed liquid decreasing by supplying of liquid to the printer, by again injecting liquid inside the liquid housing unit of the housed liquid housing body (see JP-A-2004-358802 (Patent Document 1), for example).

SUMMARY

However, with a liquid housing container of a constitution equipped with a liquid housing body inside a case member, when liquid is initially injected and housed in a liquid housing unit, typically, this is performed with the liquid housing unit (liquid housing body) housed in advance inside the case member. Therefore, when the liquid housing unit is formed using a flexible member such as a film material or the like, the liquid housing unit swells up to the state according to the volume of injected liquid allowed inside the case member. Specifically, the initially housed volume of the liquid housed in the liquid housing unit becomes the injected volume for the state when the swelling of the liquid housing unit has swelled until it is restricted by the case member.

However, when recycling the liquid housing container by again injecting liquid inside the liquid housing unit of a used liquid housing body for which the housed liquid has been used up, to provide an opening part for injecting liquid into the liquid housing unit, it is necessary to take the liquid housing body from inside the case member to outside the case member. Because of this, for example, the volume of liquid that can be injected into the liquid housing unit of the liquid housing body taken out to outside the case member does not have the swelling of the liquid housing unit restricted by the case member, so it is possible for there to be cases when it is a volume that exceeds the initially housed volume. In that case, the liquid housing unit for which the volume of liquid injected exceeds the initially housed volume in this way has the problem of it being difficult to house it inside the case member again.

This circumstance is not limited to the liquid housing container mounted on the mounting unit of the printer, but is also generally common to a liquid housing container equipped with a liquid housing body having a liquid housing unit which is capable of housing liquid inside a case member.

The present invention was created considering these circumstances, and an advantage is to provide a recycling method of a liquid housing container for which it is possible to again house inside a case member a liquid housing body after liquid is injected in a liquid housing unit a state with the liquid housing body removed from the case member, and a liquid housing container.

Following, we will note the means for solving the problems noted above, and the effects thereof.

The liquid housing container recycling method to address the problems noted above is a liquid housing container recycling method for a liquid housing container that includes a liquid housing body having a liquid housing unit that is configured to house liquid, and a supply member with a supply port that is configured to be connected to a liquid supply tube provided on a liquid consuming device, and a case member having a first case member that houses the liquid housing body, and a second case member that is attached to the first case member in a state with the supply port being exposed. The liquid housing container recycling method includes removing the second case member from the first case member, taking out the liquid housing body from inside of the first case member, forming on the liquid housing body an opening part that communicates with the inside of the liquid housing unit, injecting into the inside of the liquid housing unit from the opening part that is formed the liquid of a volume that is smaller than an initially housed volume when the liquid is initially injected and housed in the liquid housing unit of the liquid housing body in a state of being housed inside the case member, sealing the opening part of the liquid housing body, housing inside the first case member the liquid housing body for which the opening part is sealed, and attaching the second case member to the first case member.

With this method, when injecting liquid into the liquid housing unit to recycle the liquid housing container, liquid of a lower volume than the initially housed volume when liquid is initially injected and housed in the liquid housing unit of the liquid housing body in a state housed in the case member is injected in the liquid housing unit of the liquid housing body that has been taken out from inside the case member to outside the case member. Therefore, it is possible to again house inside the case member the liquid housing body after injection of the liquid into the liquid housing unit outside the case member.

With the liquid housing container recycling method noted above, it is preferable that the first case member has an opening area through which the liquid housing body being insertable and removable, and that is closed by the second case member, the taking out of the liquid housing body includes taking out the liquid housing body from the first case member via the opening area, and the housing of the liquid housing body includes inserting and housing the liquid housing body for which the opening part is sealed inside the first case member from the opening area.

With this method, it is possible to take out the liquid housing body from the formed opening area of the first case member without dividing or dismantling the first case member into a plurality of members, for example. Also, after injection of the liquid into the liquid housing unit, by inserting the liquid housing body into the first case member from the opening area, it is possible to easily house the liquid housing body inside the case member.

With the liquid housing container recycling method noted above, it is preferable the supply member has a supply flow path in which the liquid flows from the liquid housing unit to the supply port, with the supply flow path having a detection chamber that is configured to detect a volume of the liquid inside the liquid housing unit on the same side surface as a member surface on which the supply port is formed. The liquid housing container recycling method further includes setting the liquid housing body to a first orientation in which the supply port is at a position further to the antigravity direction side in a vertical direction than the detection chamber, and in which a normal line direction of the member surface is inclined at an angle of +1 degree or more and less than +90 degrees from a horizontal direction facing the antigravity direction side during the injecting of the liquid, or after the injecting of the liquid and before the housing of the liquid housing body.

With this method, for example the air bubbles that mix in when injecting the liquid are moved to the antigravity direction side, so it is possible to exhaust the air bubbles inside the detection chamber via the supply port positioned further to the antigravity direction side than the detection chamber using the first orientation.

With the liquid housing container recycling method noted above, it is preferable that a portion of the injected liquid be exhausted from the supply port after the setting of the liquid housing body to the first orientation and before the housing of the liquid housing body.

With this method, air bubbles are led to the supply port by the flow of liquid exhausted from the supply port, so it is possible to smoothly exhaust air bubbles from the supply port.

With the liquid housing container recycling method noted above, it is preferable that the liquid housing container recycling method further includes setting the liquid housing body to a second orientation in which the opening part is at a position further to the antigravity direction side in the vertical direction than the supply port, and in which the normal line direction of the member surface is inclined at an angle of −45 degrees or greater and less than +1 degree from the horizontal direction facing the antigravity direction side after the setting of the liquid housing body to the first orientation and before the housing of the liquid housing body.

With this method, for example even when the air bubbles mixed in when injecting the liquid are pooled inside the detection chamber in the first orientation, it is possible to exhaust the pooled air bubbles inside the detection chamber to the supply port by using the second orientation.

With the liquid housing container recycling method noted above, it is preferable that the liquid housing container recycling method further includes sealing the supply port after the setting of the liquid housing body to the first orientation and before the housing of the liquid housing body.

With this method, the supply port is sealed after exhausting the air bubbles inside the detection chamber, so it is possible to recycle the liquid housing container in a state for which it is possible for the detection chamber to detect the volume of liquid inside the liquid housing unit.

With the liquid housing container recycling method noted above, it is preferable that the opening part of the liquid housing body is positioned further to the antigravity direction side than the supply port when the liquid housing body is put in the first orientation during the opening of the opening part.

With this method, for example in the first orientation for which air bubbles mixed in when injecting the liquid are exhausted from the supply port, the opening part is positioned further to the antigravity direction side than the supply port, so exhausting of the liquid from the opening part is suppressed when the liquid housing body is in the first orientation.

The liquid housing container for addressing the problems noted above is a liquid housing container recycled by the liquid housing container recycling method noted above.

With the liquid housing container of this constitution, it is possible to easily insert the liquid housing body into the second case member from the opening area of the second case member after injection of the liquid to the liquid housing unit outside the case member to house it inside the case member.

The liquid housing container for addressing the problems noted above is a liquid housing container includes a liquid housing body having a liquid housing unit that is configured to house liquid, and a supply member with a supply port that is configured to be connected to a liquid supply tube provided on a liquid consuming device, and a case member having a first case member that houses the liquid housing body and has an opening area through which the liquid housing body is insertable and removable, and a second case member that is attached to the first case member in a state with the supply port being exposed to close the opening area. The liquid housing body is configured to house the liquid of a volume that is smaller than an initially housed volume of the liquid when the liquid is initially injected into the liquid housing unit of the liquid housing body in a state of being housed inside the case member.

With this constitution, when injecting liquid into the liquid housing unit, liquid is housed at a lower volume than the initially housed volume when first housing by injection to the liquid housing unit of the liquid housing body in a state house inside the first case member, so it is possible to easily insert the liquid housing body after injection of the liquid to the liquid housing unit inside the first case member from the opening area of the first case member.

The liquid housing container noted above preferably includes a memory provided to the case member and configured to store information indicating the initially housed volume of the liquid that is initially housed in the liquid housing unit.

With this constitution, using the information stored in the memory equipped in the liquid housing container that is subject to injection again, it is possible to reliably inject into the liquid housing unit liquid of a volume lower than the initially housed volume when initially housed in the liquid housing unit.

The liquid housing container recycling method for addressing the problems noted above is a liquid housing container recycling method for a liquid housing container that includes a liquid housing body having a liquid housing unit that is configured to house liquid, and a supply member with a supply port that is configured to be connected to a liquid supply tube provided on a liquid consuming device, and a case member having a first case member that houses the liquid housing body, and a second case member that is attached to the first case member in a state with the supply port being exposed. The liquid housing container recycling method includes removing the second case member from the first case member, taking out the liquid housing body from inside of the first case member, forming on the liquid housing body an opening part that communicates with the inside of the liquid housing unit, housing the liquid housing body on which the opening part is formed inside the first case member, injecting into the inside of the liquid housing unit from the opening part that has been formed the liquid of a volume that is smaller than an initially housed volume of the liquid when the liquid is initially injected and housed in the liquid housing unit of the liquid housing body in a state of being housed inside the case member, sealing the opening part of the liquid housing body, and attaching the second case member to the first case member.

With this method, when injecting liquid into the liquid housing unit to recycle the liquid housing container, injection is done to the liquid housing unit in the liquid housing body in a state housed inside the case member. Therefore, for the volume of liquid injected for recycling, it is possible to easily inject liquid of a lower volume than the initially housed volume when the liquid is initially injected and housed into the liquid housing unit of the liquid housing body housed inside the case member. Therefore, it is possible to again house inside the case member the liquid housing body after injection of liquid into the liquid housing unit outside the case member.

BRIEF DESCRIPTION OF THE DRAWINGS

Referring now to the attached drawings which form a part of this original disclosure:

FIG. 4A is a drawing showing the state before the ink flows out, and FIG. 4B shows the state when the ink has flowed out;

DETAILED DESCRIPTION OF EMBODIMENTS

Figure 1:
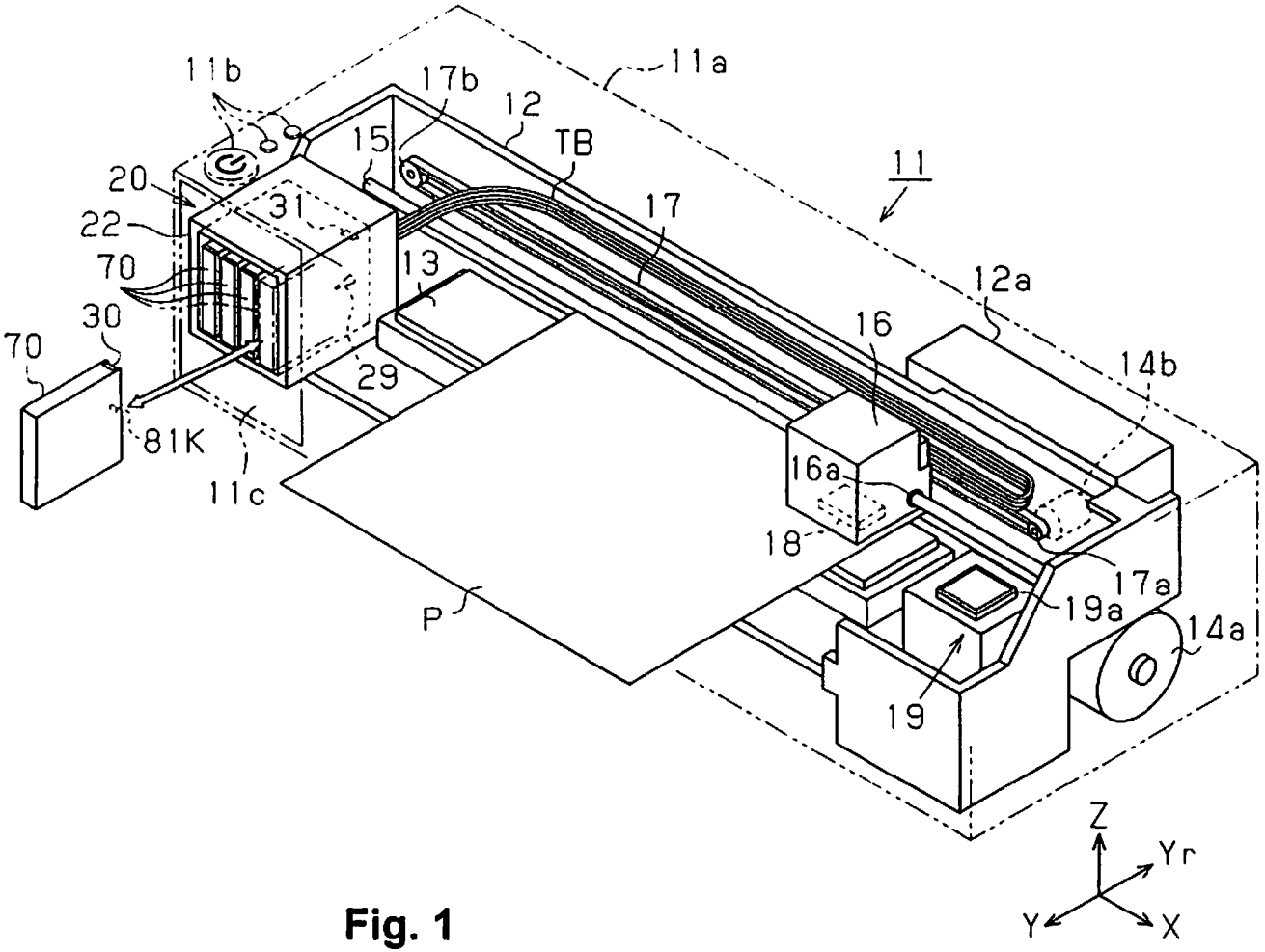
FIG. 1 is a schematic perspective view showing an embodiment of a printer which is an example of a liquid consuming device.

Following, we will describe an embodiment of an inkjet printer which is an example of a liquid consuming device while referring to the drawings. The printer of this embodiment performs printing on a paper P by forming (recording) an image or the like by spraying, specifically, consuming, ink which is an example of a liquid on the paper P which is an example of a target conveyed in one direction.

As shown in FIG. 1, the printer 11 of this embodiment is equipped with a case 11*a* having a roughly rectangular solid shape, a portion of which is shown by a double dot-dash line, and on the top surface of the antigravity direction Z side in the vertical direction, provided is an operating button 11*b* such as a power button or the like for driving the printer 11, and a display unit (not illustrated). Also, an open and closeable cover 11*c* is provided on the front surface of the case 11*a* which is the conveyance direction Y side in which the paper P is conveyed. In a state with this cover 11*c* open, it is possible for the user to access the interior of the case 11*a*.

At the bottom part that becomes the gravity direction side inside a frame 12 housed in an internal space covered by this case 11*a*, a support base 13 which has the direction orthogonal to the paper P conveyance direction Y as the lengthwise direction is provided extending in roughly the horizontal direction. A paper feed motor 14*a* is provided on the rear side of the support base 13 (the side opposite to the paper P conveyance direction Y). Specifically, using a paper feed mechanism (not illustrated) that operates by the driving of this paper feed motor 14*a*, the paper P is fed facing the conveyance direction Y side on the support base 13.

Also, upward, which becomes the antigravity direction side of the support base 13, a guide shaft 15 is stretched across along the lengthwise direction of the support base 13. A carriage 16 is supported so as to be able to move back and forth in the axis line direction on this guide shaft 15. More specifically, a support hole 16*a* that pierces through in the lateral direction is formed on the carriage 16, and the guide shaft 15 is inserted through this support hole 16*a*.

A driving pulley 17*a* and a driven pulley 17*b* are respectively supported to be able to rotate freely at positions near both ends of the guide shaft 15 noted above on the back wall inner surface of the frame 12. An output shaft of a carriage motor 14*b* is coupled to the driving pulley 17*a*, and a seamless timing belt 17 for which a portion is coupled to the carriage 16 is wound between the driving pulley 17*a* and the driven pulley 17*b*. Also, by the carriage motor 14*b* being driven, while the carriage 16 is guided by the guide shaft 15 via the timing belt 17, it moves back and forth in the lengthwise direction, specifically, along the scanning direction X. A liquid spray head 18 which is an example of a liquid spray unit is provided on the bottom side of this carriage 16, and the ink supplied to this liquid spray head 18 is sprayed from the liquid spray head 18 and consumed, and an image is printed on the paper P.

Supplying of ink to the liquid spray head 18 is performed by an ink cartridge 70 which is an example of the liquid housing container mounted so as to be able to be inserted and removed in relation to a mounting unit 20 equipped inside the case 11*a*. Specifically, the mounting unit 20 for which the ink cartridge 70 can be inserted and removed is arranged at the left side in the scanning direction X seen from the case 11*a* conveyance direction Y tip, and an ink supply tube TB capable of flowing ink is coupled between the mounting unit 20 and the carriage 16.

With this embodiment, the mounting unit 20 is constituted with four roughly solid rectangle form ink cartridges 70 capable of being mounted so as to be aligned along the horizontal direction (here, along the scanning direction X) inside the roughly box shaped cartridge holding body 22 that opens at the opposite direction side to the insertion direction Yr (here, the conveyance direction Y side). Housed in the four ink cartridges 70, for example, are mutually different colors of cyan, magenta, yellow, and black ink. Also, each ink cartridge 70 can be inserted and removed in the direction of the white outline arrow in the mounting unit 20 inside the case 11*a* in a state with the cover 11*c* opened.

Also, on the mounting unit 20, a supply needle 29 which is an example of a liquid supply tube is provided in the inner wall of the cartridge holding body 22 that is the Yr tip side of the insertion direction of the ink cartridge 70. By a supply port 81K of the ink cartridge 70 being connected to the supply needle 29, ink is supplied from the ink cartridge 70 to the supply needle 29. Therefore, four supply needles 29 are equipped corresponding to each ink cartridge 70. With FIG. 1, only one supply needle 29 is illustrated.

Also, the ink supplied to the supply needle 29 is sent to the liquid spray head 18 via the ink supply tube TB from the ink flow path formed on the mounting unit 20 by the operation of a pump (not illustrated) (e.g. a diaphragm pump) equipped in the mounting unit 20. With this embodiment, the insertion direction Yr of the ink cartridge 70 is the opposite direction to the conveyance direction Y of the paper P. Of course, it is also possible to not necessarily have the insertion direction Yr be the opposite direction to the conveyance direction Y.

Meanwhile, in the area further to the scanning direction X right side seen from the conveyance direction Y tip side than the support base 13 in the frame 12 interior, specifically, the home position area that is not used during printing, provided is a maintenance device 19 having a box shaped cap with a bottom 19*a* that is opened upward and a suction pump or the like (not illustrated). Also, with the printer 11, after the carriage 16 is moved to the home position area, with this maintenance device 19, a maintenance operation is performed that does maintenance so that ink is sprayed stably from the liquid spray head 18.

The various operations performed by this kind of printer 11 are controlled by a control unit. With this embodiment, the control unit is constituted by a circuit substrate on which are mounted electrical components such as a CPU, RAM, ROM or the like. The control unit is arranged inside a case 12*a* equipped to the rear of the frame 12, for example.

Furthermore, when the ink cartridge 70 is mounted in the mounting unit 20, the control unit performs communication of designated information (e.g. data such as ink cartridge 70 type identification data or the initially housed volume of ink and remaining volume of ink or the like) with memory (not illustrated) which is an example of a storage device equipped in the ink cartridge 70.

This information communication is specifically performed by an electrical connection between an electrical connection part 31 constituted by terminals or the like equipped in the mounting unit 20 (cartridge holding body 22), and an electrical connection part 30 constituted by a circuit substrate for which terminals are formed equipped in the ink cartridge 70. Therefore, four electrical connection parts 31 are equipped according to the number of ink cartridges 70 in the mounting unit 20. In FIG. 1, only one electrical connection part 31 is illustrated.

Next, we will describe the constitution of the ink cartridge 70.

Figure 2:
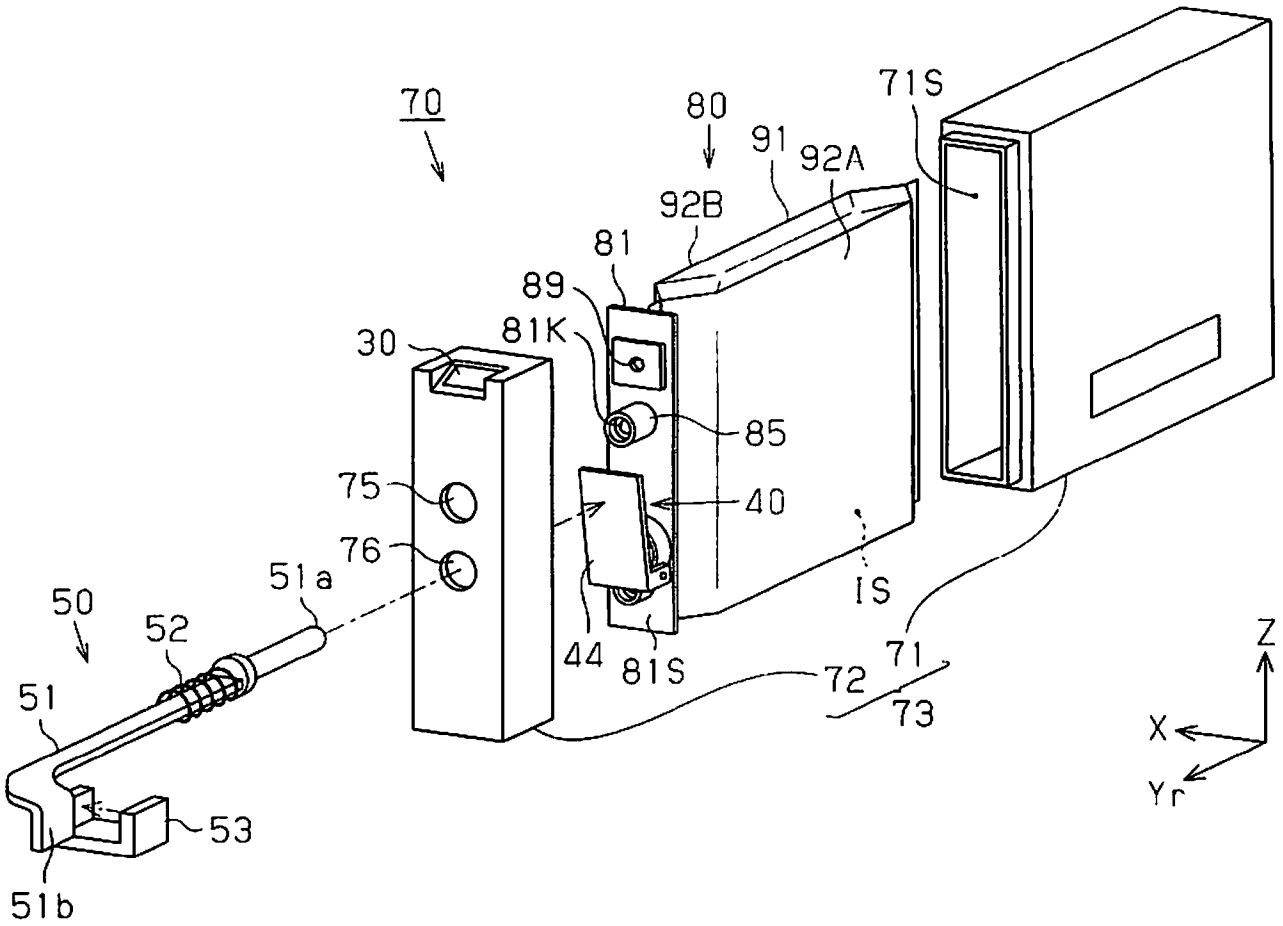
FIG. 2 is a perspective view showing the ink cartridge constitution and the ink detection mechanism.

As shown in FIG. 2, the ink cartridge 70 has an ink pack 80 as the liquid housing body housed inside a case member 73 for which two members are combined, a first case member 71 on the rear side of the insertion direction Yr when mounting in the mounting unit 20, and a second case member 72 on the front side of the insertion direction Yr.

The first case member 71 has roughly a box shape having an opening area 71S in which the ink pack 80 can be inserted and removed at the insertion direction Yr side, and in a state with the ink pack 80 inserted inside the first case member 71, the second case member 72 is attached to the first case member 71 so as to close the opening area 71S of the first case member 71. With this embodiment, the second case member 72 is made to be able to be attached (assembled) by fitting into the first case member 71, and after attaching, by pulling the second case member 72 so as to pull away, can be removed from the first case member 71.

The ink pack 80 is equipped with a supply member 81 on which the supply port 81K is provided, and a bag shaped pack body 91 which is an example of the liquid housing unit joined to this supply member 81. The pack body 91 has its opening side 91*a* (see FIG. 6) joined to the supply member 81, and has an ink chamber IS formed as a liquid housing space for which ink can be housed in its interior.

With this embodiment, the pack body 91 is formed using a flexible sheet member, and two sheet members including pack member 92A and pack member 92B arranged facing opposite in the scanning direction X are deformed so that the mutual gap increases and decreases according to the volume of ink (liquid volume) housed inside the ink chamber IS.

The supply member 81 has the side opposite to the side at which the pack body 91 is joined as the roughly flat member surface 81S, and on this member surface 81S, an injection port 89 for injecting ink into the ink chamber IS is provided. With this embodiment, when first (initially) injecting ink into the ink chamber IS, ink is injected from the injection port 89 in a state with the ink pack 80 inserted inside the first case member 71. Along with this injection of ink, the pack body 91 swells so as to increase the gap between the pack member 92A and the pack member 92B. Also, until a state is reached whereby the swelling of the pack body 91 is restricted by abutting on the inner wall of the first case member 71, the ink volume injected into the ink chamber IS is the initially housed volume of ink of the ink cartridge 70. This initially housed volume of ink is stored in the memory equipped in the ink cartridge 70 via the electrical connection part 30 equipped in the second case member 72. The memory is arranged at the rear surface of the electrical connection part 30 (side facing opposite the second case member 72).

The injection port 89 is sealed after injection of ink to the ink pack 80 has ended. With this embodiment, a sealing member 99 (see FIGS. 4A and 4B) is inserted in the injection port 89 and the injection port 89 is sealed. Alternatively, the injection port 89 can also be sealed by adhering of a resin material or the like, or the injection port 89 can be sealed by fusion of the supply member 81. Alternatively, it is also possible for the injection port 89 to be sealed by sticking on a seal or the like.

Also, on the supply member 81, a tube shaped flow path part 85 projecting from the member surface 81S to the insertion direction Yr is formed, and the supply port 81K is formed opening at the insertion direction Yr side end part of this tube shaped flow path part 85. Also, the supply port 81K is exposed from a supply port hole 75 provided on the second case member 72 when the second case member 72 is attached to the first case member 71 in a state with the ink pack 80 housed in the first case member 71.

Also, on the supply member 81, formed is a detection unit 40 capable of determining the residual state of ink housed in the ink chamber IS within the pack body 91 further to the gravity direction side than the supply port 81K which is the same surface side as the member surface 81S on which the supply port 81K is formed. Also, on the supply member 81, provided is a supply flow path by which ink flows from the pack body 91 to the supply port 81K, and the detection unit 40 is provided midway in this supply flow path. The supply flow path will be described later.

Furthermore, on the supply member 81 is attached a moving member 44 that moves according to the flow of the ink in the supply flow path as a member constituting the detection unit 40. An ink detection mechanism 50 having a rod shaped member 51 that can move by sliding in cooperation with the movement of the moving member 44 by being pressure welded to this moving member 44 is equipped at the mounting unit 20 side of the printer 11.

The ink detection mechanism 50 is constituted having the rod shaped member 51 which has one end part 51*a* for which the tip end is rounded to roughly a hemisphere shape, a spring 52 that energizes the rod shaped member 51 so as to have the one end part 51*a* pressure welded to the moving member 44, and a concave shaped sensor 53. The sensor 53 uses an optical sensor for which a light emitting unit and light receiving unit (not illustrated) are provided facing opposite. Also, another end part 51*b* on the side opposite to the one end part 51*a* on the rod shaped member 51 blocks the light emitted by the light emitting unit with the concave shape as shown by the dotted lines in FIG. 2 so as to not allow the light receiving unit to receive light. The detection signals output from the sensor 53 according to blocking of light by this other end part 51*b* are input to the control unit. Therefore, the other end part 51*b* with the rod shaped member 51 is used as the detection subject site for detecting ink.

To operate this ink detection mechanism 50, on the second case member 72, provided is an insertion hole 76 for inserting the one end part 51*a* of the rod shaped member 51 so as to be able to abut the moving member 44 when assembling to the first case member 71 in a state with the ink pack 80 housed.

Next, we will describe the constitution of the detection unit 40.

Figure 3:
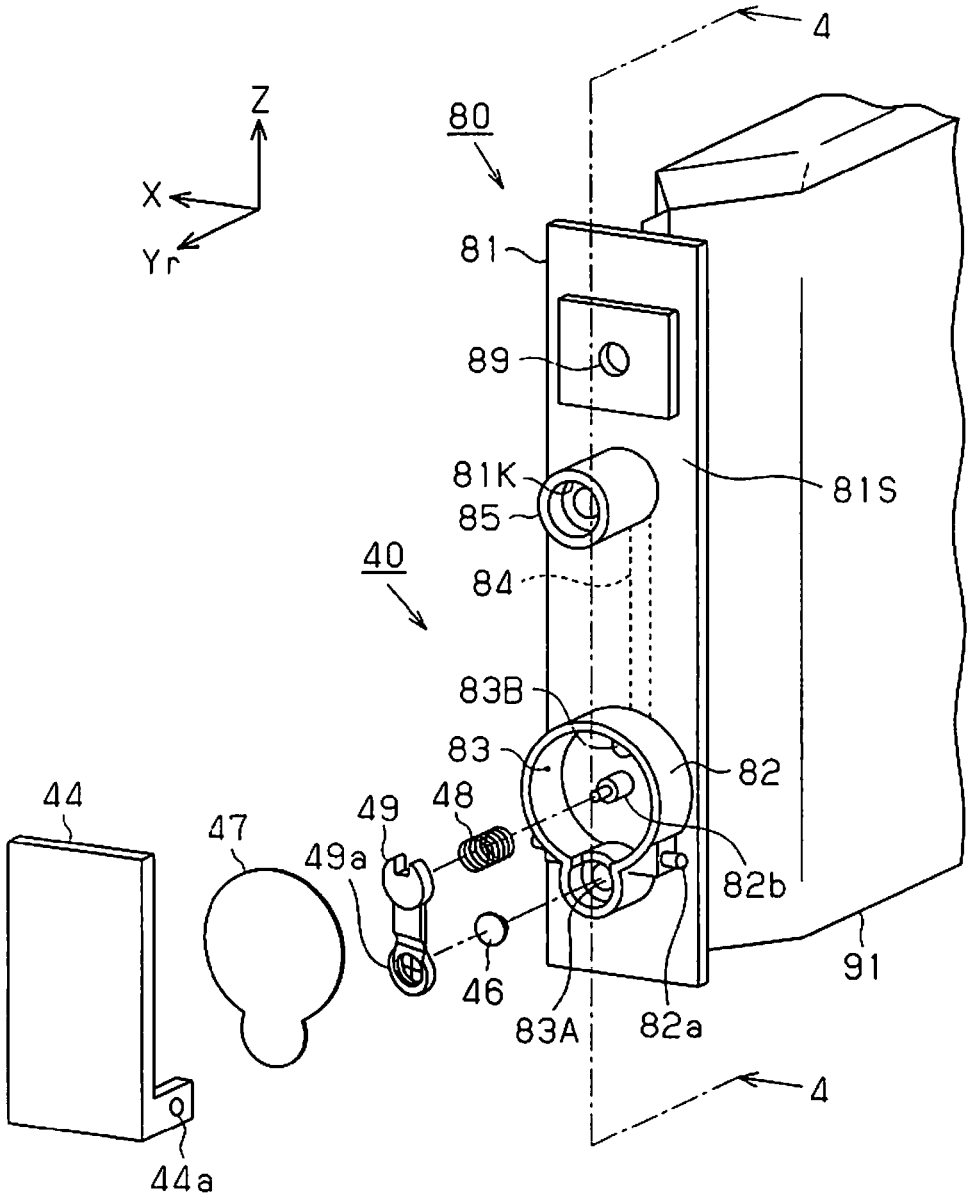
FIG. 3 is an exploded perspective view showing the supply member and ink detection mechanism structure.

As shown in FIG. 3, the detection unit 40 is constituted having a detection chamber 83 enclosed by a roughly round tube shaped outside wall 82 and film 47 formed on the member surface 81S of the supply member 81, and the moving member 44 with an axis made to be able to rotated on the supply member 81.

On the inside of the detection chamber 83, an inflow flow path 83A that gives communication between this detection chamber 83 and the pack body 91 interior is formed along the roughly perpendicular line direction of the member surface 81S at the gravity direction side end of the detection chamber 83. On the inside of the detection chamber 83 is provided a non-return valve 46 that restricts the backflow of ink that has flowed in through the inflow flow path 83A from the pack body 91 side.

Also, the flexible film 47 is adhered to the outside wall 82 so as to cover the opening on the insertion direction Yr side of the detection chamber 83. Because of that, with the detection chamber 83, when the film 47 is deformed along with internal pressure changes, the capacity changes. Also, on the inside of the detection chamber 83, a spring 48 that energizes the film 47 facing the outside of the detection chamber 83 is supported by a convex part 82*b* erected on the bottom surface of the detection chamber 83. Between the spring 48 and the film 47, a pressure receiving plate 49 is inserted that conveys energizing force to the film 47 while receiving and displacing the energizing force of the spring 48. This receiving plate 49 is equipped with a movement restriction part 49*a* for restricting the non-return valve 46 so as not to allow flow into the detection chamber 83.

In this way, the moving member 44 is attached to the outer surface of the detection chamber 83 formed on the supply member 81. The moving member 44 has a rotation axis 82*a* provided on an outside wall 82 extending along the horizontal direction crossing the insertion direction Yr of the ink cartridge 70 to the mounting unit 20 inserted in an axis hole 44*a* provided on the moving member 44, and is made to rotate freely (oscillate freely) with the rotation axis 82*a* as the center. Also, the moving member 44 has its contact part 44*b* (see FIGS. 4A and 4B) in contact from outside the detection chamber 83 on the film 47 constituting a portion of the inner surface of the detection chamber 83.

On the supply member 81, a flow path is formed for which the ink that flowed into the detection chamber 83 from the inflow flow path 83A flows up to the supply port 81K adjacent to the detection chamber 83 at the member surface 81S of the supply member 81. Specifically, in communication with the detection chamber 83 at the supply member 81, an outflow flow path 83B in which ink flows along roughly the perpendicular line direction (normal line direction) of the member surface 81S is provided at the antigravity direction Z side end which is the side opposite the inflow flow path 83A of the detection chamber 83. Also, connected to this outflow flow path 83B, a lead-out flow path 84 that leads ink to the supply port 81K is provided with a flow path that bends to the supply port 81K side after extending in the direction crossing the outflow flow path 83B.

Figure 4B:
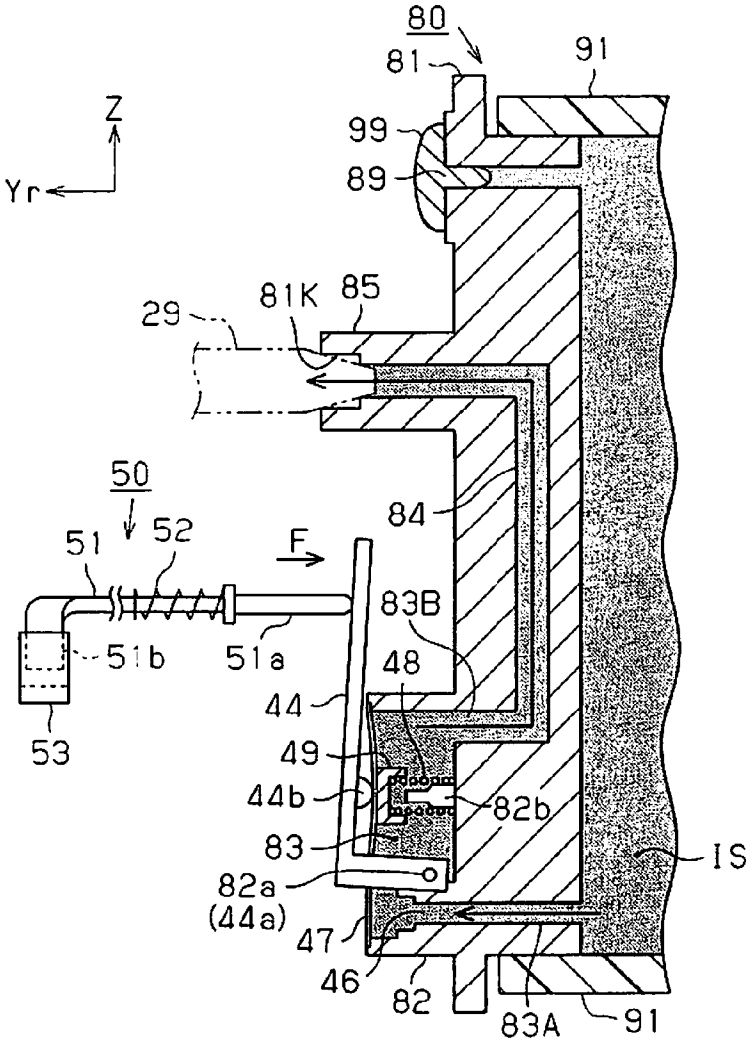
FIGS. 4A and 4B are explanatory drawings showing the operation of the ink detection mechanism, where
Figure 4A:
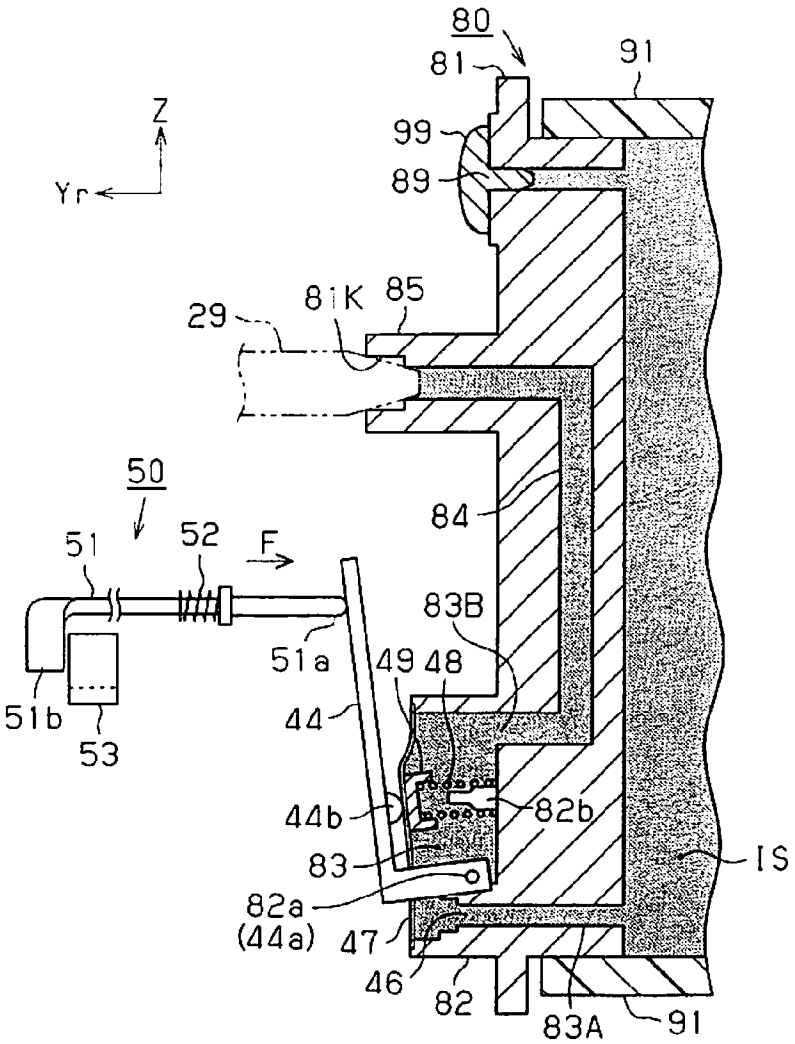

Therefore, as shown by the shaded part in FIGS. 4A and 4B, with this embodiment, with the supply member 81, as the supply flow path of ink from the ink chamber S inside the pack body 91 to the supply port 81K, the inflow flow path 83A, the detection chamber 83, the outflow flow path 83B, and the lead-out flow path 84 are equipped. In FIGS. 4A and 4B, the ink pack 80 is shown with a cross section in the arrow view of line 4-4 in FIG. 3.

Next, we will describe the operation of the detection unit 40 and the ink detection mechanism 50 while referring to FIGS. 4A and 4B.

First, as shown in FIG. 4A, when the ink cartridge 70 in which ink of the initially housed volume is housed in the ink chamber IS inside the ink pack 80 is mounted in the mounting unit 20, the ink inside the ink chamber IS is in a state flowed into the detection chamber 83 via the inflow flow path 83A. With this state, the film 47 is pressed in the direction that increases the capacity of the detection chamber 83, so the contact part 44*b* of the moving member 44 is pressed by the film 47 and rotates to the insertion direction Yr side with the rotation axis 82*a* as the center. Also, one end part 51*a* of the rod shaped member 51 presses against the inner side inside the cartridge holding body 22 (insertion direction Yr side) in resistance to the energizing force F of the spring 52 by the moving member 44.

As a result, by the rod shaped member 51 moving to the insertion direction Yr side, the other end part 51*b* of the rod shaped member 51 is in a state separated from the sensor 53. Because of that, the sensor 53 is in a light transmitting state, so detection signals according to the light transmission are output to the control unit. Then, the control unit to which the output detection signals have been input determines that ink is remaining in the ink cartridge 70.

Next, as shown in FIG. 4B, because ink is suctioned from the supply port 81K to the supply needle 29 by the operation of a pump that was stopped, the ink inside the detection chamber 83 goes through the outflow flow path 83B and flows out to the lead-out flow path 84. Here, with this embodiment, the inner diameter of the outflow flow path 83B is set to be larger than the inner diameter of the inflow flow path 83A, so the volume of ink flowing out from the detection chamber 83 cannot keep up with the volume of ink flowing into the detection chamber 83, resulting in negative pressure inside the detection chamber 83. Because of that, the film 47 deforms so as to be pulled to inside the detection chamber 83 in resistance to the energizing force of the spring 48.

Then, along with the deformation of the film 47, the moving member 44 is pressed by the one end part 51*a* of the rod shaped member 51 energized by the spring 52, and with the rotation axis 82*a* as the center, rotates so that the contact side with the rod shaped member 51 moves to the side opposite to the insertion direction Yr. As a result, the other end part 51*b* of the rod shaped member 51 is inserted between the light emitting part and the light receiving part of the sensor 53, so the sensor 53 is in a state with the light blocked.

From this state, if in a state with sufficient ink remaining in the ink chamber IS inside the ink pack 80, when a designated time elapses after stopping of the supply of ink to the supply needle 29 by stopping the operation of the pump, the ink inside the ink chamber IS flows into the detection chamber 83 via the inflow flow path 83A. Having done that, since the film 47 is pressed in the direction that increases the capacity of the detection chamber 83, the contact part 44*b* of the moving member 44 is pressed by the film 47 and rotates to the insertion direction Yr side with the rotation axis 82*a* as the center. Also, the one end part 51*a* of the rod shaped member 51 is pressed to the inner side inside the cartridge holding body 22 (insertion direction Yr side) in resistance to the energization force F of the spring 52 by the moving member 44.

As a result, as shown in FIG. 4A, by the rod shaped member 51 moving to the insertion direction Yr side, the other end part 51*b* of the rod shaped member 51 is separated from the sensor 53. Because of that, the sensor 53, based on changing from a light blocking state to a transmitting state along with the movement of the rod shaped member 51, outputs detection signals to the control unit according to the light transmission. The control unit to which the output detection signals were input determines that there is ink remaining in the ink cartridge 70.

Meanwhile, when in a state when ink does not remain in the ink chamber IS inside the ink pack 80, even if a designated time elapses after driving of the pump stops, ink does not flow in from inside the ink chamber IS to the detection chamber 83. In that case, with the film 47, the state shown in FIG. 4B, specifically, the state of deforming in the direction for which the capacity of the detection chamber 83 decreases, is maintained, and the state of having the other end part 51*b* of the rod shaped member 51 inserted between the light emitting part and the light receiving part of the sensor 53 is maintained. Because of that, the sensor 53 detects that the ink inside the ink pack 80 has run out based on the fact that the light blocked state is maintained even when a designated time elapses from the stopping of the pump operation.

The ink cartridge 70 for which it is detected that the ink within the ink pack 80 has run out by the operation of the detection unit 40 and the ink detection mechanism 50 in this way undergoes the recycling process by again injecting ink into the ink chamber IS inside the ink pack 80.

Next, referring to FIG. 5 through FIG. 9, we will describe the recycling operation of again injecting ink in the ink cartridge 70 of this embodiment, specifically, the recycling process of the ink cartridge 70. This process is performed by the recycler based on the information of the ink cartridge 70. The recycler is for example the user who visually confirms a display showing that the remaining ink volume inside the ink cartridge 70 is low displayed on the display unit of the case 11*a*, or is a worker delegated by the user. With FIG. 6 to FIG. 9, with the ink pack 80, constitutional members for the detection unit 40 are omitted as appropriate, and only the constitution relating to the detection chamber 83 which is a portion of the supply flow path is illustrated.

Figure 5:
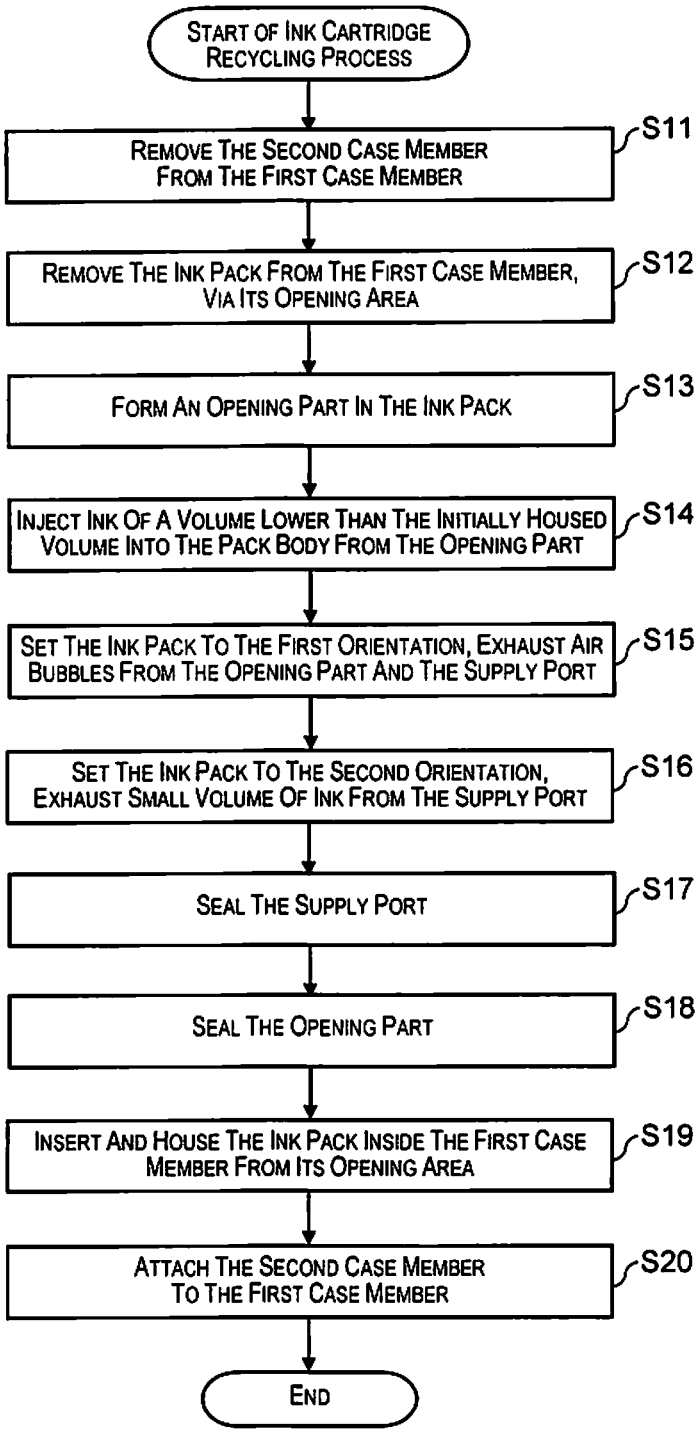
FIG. 5 is a flow chart showing the ink cartridge recycling processing method.

As shown in FIG. 5, with the recycling process of this ink cartridge, first, at step S11, the process of removing the second case member 72 from the first case member 71 is performed (removal step). After taking out the ink cartridge 70 that is subject to recycling from the mounting unit 20 of the printer 11, the recycler pulls out and removes the second case member 72 from the first case member 71.

Next, at step S12, the process of taking out the ink pack 80 from the first case member 71 via the opening area 71S is performed (taking out step). The ink pack 80 is in a state for which the pack body 91 is contracted because the remaining ink volume inside the ink chamber IS is low. Because of that, it is possible for the recycler to easily take out the ink pack 80 from the opening area 71S of the first case member 71 and remove it from the first case member 71. With the process here, in the case of a structure for which the ink pack 80 is attached to the second case member 72, the process of removing the ink pack 80 from the second case member 72 is performed together.

Next, at step S13, the process of forming on the ink pack 80 an opening part 99K that communicates with the interior of the pack body 91 is performed (opening forming step). Here, by opening a hole in the sealing member 99 that seals the injection port 89 and exposing the injection port 89, the opening part 99K that communicates from outside the pack body 91 to inside the pack body 91 is formed. It is also possible for the injection port 89 to be exposed by pulling out, cutting, or removing the sealing member 99, and for the exposed injection port 89 to be formed as the opening part 99K.

Subsequently, at step S14, the process of injecting ink of a volume lower than the initially housed volume into the pack body 91 from the opening part 99K is performed (injection step). Here, the recycler of the ink cartridge 70 uses a device that can communicate with memory via the electrical connection part 30 or the like to fetch the initially housed volume of ink of the ink cartridge 70 stored in the memory. Then, ink of a volume lower than the fetched initially housed volume is injected from the exposed injection port 89.

Figure 6:
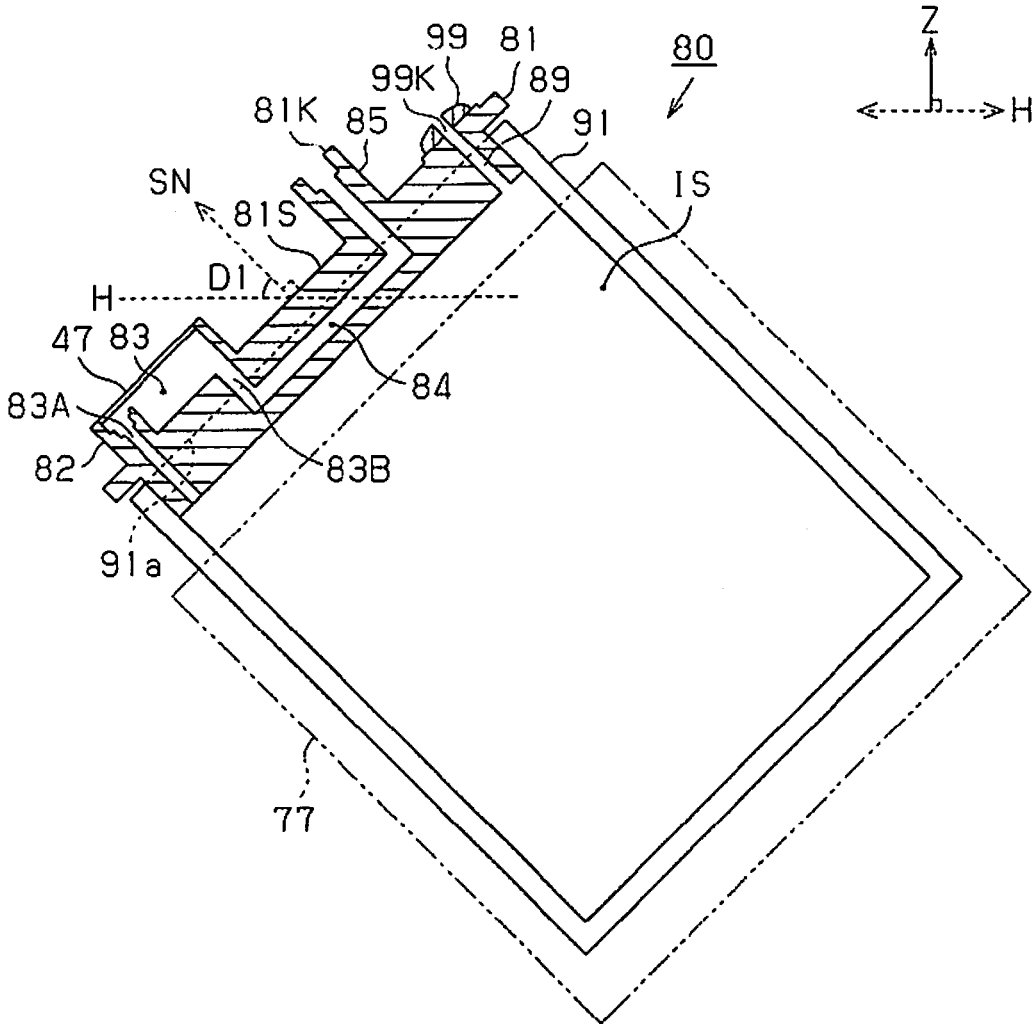
FIG. 6 is a side cross section view showing the schematic structure of the ink pack.

As shown in FIG. 6, when doing the process at step S14, this is performed in a state with the opening part 99K in communication with the interior of the pack body 91 formed by the process of step S13 inclined so as to be positioned at the furthest antigravity direction Z side. By doing this, the recycler is able to easily inject ink to every corner of the ink chamber IS inside the pack body 91 using the movement (drop) of the ink pack 80 from the opening part 99K to the ink gravity direction side.

With this embodiment, with the process of injecting ink at step S14, with the ink pack 80, the normal line direction SN of the member surface 81S of the supply member 81 is in a state inclined at a designated angle D1 facing from the horizontal direction F1 to the antigravity direction Z side. Specifically, the ink pack 80 is oriented so that the normal line direction SN of the member surface 81S is inclined at an angle of +1 degree or greater and less than +90 degrees facing from the horizontal direction H to the antigravity direction Z side.

Also, with the ink pack 80, it is also possible to have a state for which the pack body 91 is inserted inside a restriction tool 77 that restricts the swelling of the pack members 92A and 92B. By doing this, it is possible to have the swelling of the pack body 91 restricted by the restriction tool 77 so that ink of a volume that does not exceed the initially housed volume is injected inside the pack body 91.

Next, at step S15 in FIG. 5, with the ink pack 80 in the first orientation, the process of exhausting air bubbles from the opening part 99K and the supply port 81K is performed (first orientation control step). The first orientation of this step S15 is an orientation for which it is possible to exhaust air bubbles in the ink that moved to the antigravity direction Z side by buoyancy from the opening part 99K (injection port 89) and the supply port 81K. Incidentally, with this embodiment, the first orientation is the same orientation as the orientation at step S14. Specifically, it is an orientation for which the normal line direction SN of the member surface 81S of the supply member 81 is inclined by a designated angle of D1 of +1 degree or greater and less than +90 degrees facing from the horizontal direction H toward the antigravity direction Z side. Using this first orientation, the supply port 81K is positioned further to the antigravity direction Z side than the detection chamber 83. Furthermore, the opening part 99K is positioned further to the antigravity direction Z side than the supply port 81K, and is positioned to the antigravity direction Z side in the ink chamber IS.

Figure 7:
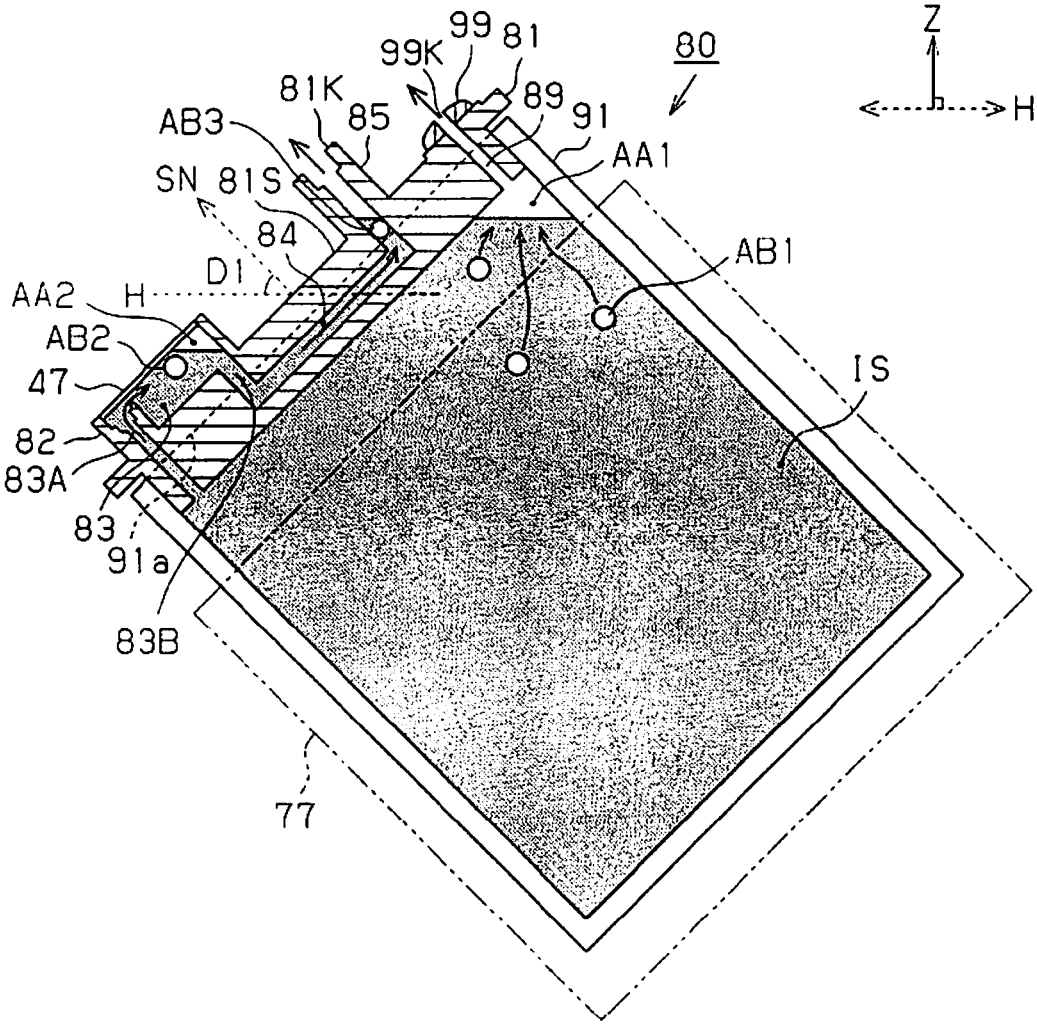
FIG. 7 is a side cross section view showing the ink pack in the state set in the first orientation.

As shown in FIG. 7, by using this kind of first orientation, the air bubbles AB1 inside the ink chamber IS (in the ink) rise inside the ink chamber IS to the injection port 89 positioned at the antigravity direction Z side, and an air pocket AA1 that communicates with the injection port 89 is formed. Specifically, the air bubbles inside the ink chamber IS are exhausted from the opening part 99K formed on the injection port 89 via the air pocket AA1 to outside the pack body 91, in other words, into the atmosphere. Also, air bubbles AB3 inside the lead-out flow path 84 move toward the supply port 81K and are discharged to the air from the supply port 81K.

Meanwhile, the air bubbles AB2 inside the inflow flow path 83A and the outflow flow path 83B flow into the detection chamber 83 side positioned at the antigravity direction Z side, and air pocket AA2 is formed inside the detection chamber 83. By using the ink cartridge 70 recycled left in a state with the air pocket AA2 formed in the detection chamber 83 with the printer 11 in this way, with the detection unit 40, by air existing in the detection chamber 83, the deformation of the film 47 becomes imprecise, so it is possible that faulty detection will occur of the remaining ink volume without the moving member 44 rotating correctly. Also, by having air bubbles flow out from the supply port 81K to the supply needle 29, it is possible that ink will not be sprayed correctly from the liquid spray head 18.

In light of that, at the next step S16 of FIG. 5, the ink pack 80 is set in the second orientation, and the process of exhausting ink of a small volume from the supply port 81K is performed (second orientation control step). The second orientation of this step S16 is an orientation for which by the air pocket AA2 (air bubbles AB2) inside the detection chamber 83 moving to the antigravity direction Z side in the ink by its buoyancy, it is possible to exhaust it from the detection chamber 83 (supply flow path) together with the small volume of ink exhausted from the supply port 81K. Incidentally, with this embodiment, this is an orientation for which the normal line direction SN of the member surface 81S of the supply member 81 is inclined at a designated angle D2 of −45 degrees or more and less than +1 degree facing from the horizontal direction H toward the antigravity direction Z side.

Figure 8:
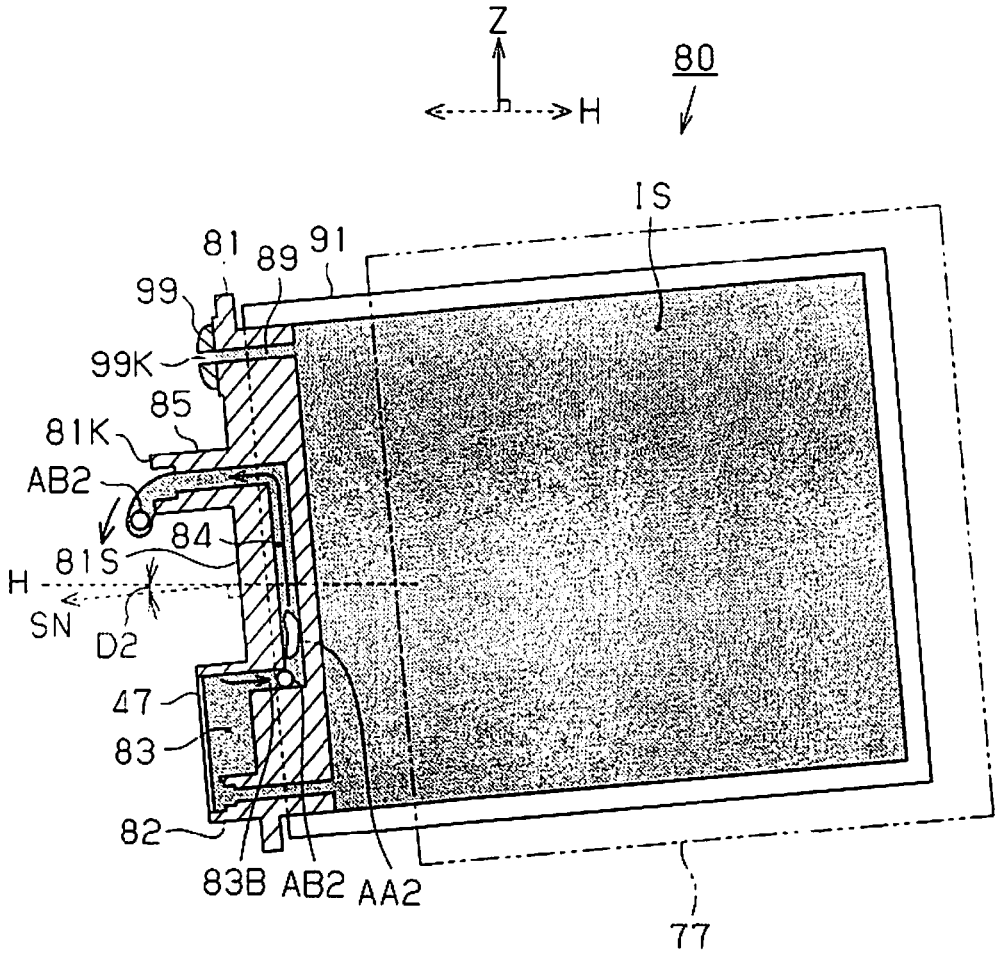
FIG. 8 is a side cross section view showing the ink pack in the state set in the second orientation.

As shown in FIG. 8, by using this kind of second orientation, the air pocket AA2 and the air bubbles AB2 inside the detection chamber 83 move to the antigravity direction Z side, specifically move to the outflow flow path 83B, after which they further move from the outflow flow path 83B to the lead-out flow path 84. Then, the air (air bubbles) that moved to the lead-out flow path 84 rises within the lead-out flow path 84 facing the supply port 81K positioned at the antigravity direction Z side, and is discharged to the atmosphere from the supply port 81K together with the ink exhausted from the supply port 81K.

With this embodiment, with the process at this step S16, the air pocket AA1 (air bubbles AB1) formed inside the ink chamber IS as well is similarly discharged to the atmosphere together with a small volume of ink exhausted from the opening part 99K via the injection port 89.

Next, at step S17 of FIG. 5, the process of sealing the supply port 81K is performed (supply port sealing step). Here, the supply port 81K is sealed after air (air bubbles) is exhausted together with ink using the second orientation by sealing with a sealing member 95 such as a film or the like. By this sealing, the ink injected into the ink pack 80 cannot be leaked out from the supply port 81K.

Figure 9:
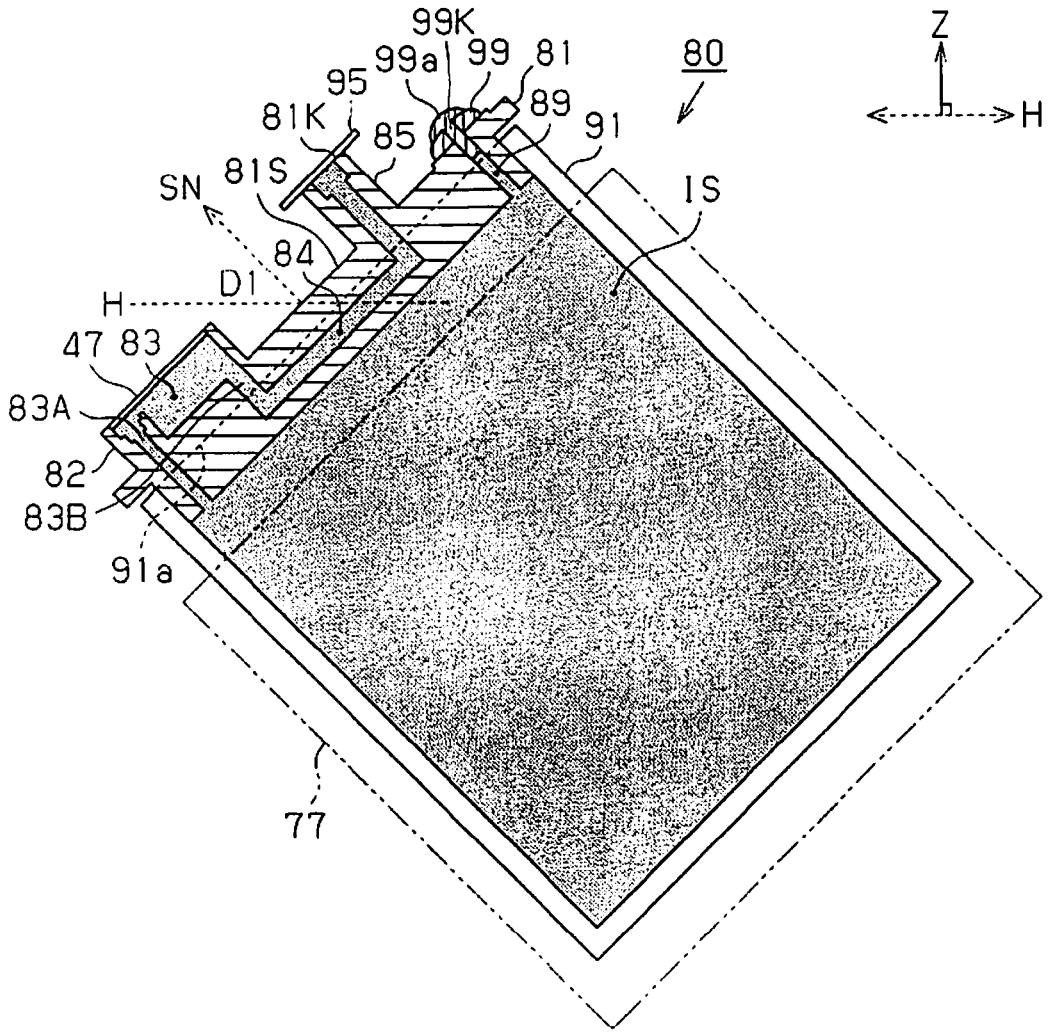
FIG. 9 is a side cross section view showing the ink pack in the state with the supply port and the opening part sealed.

As shown in FIG. 9, when doing the process of this step S17, for the ink pack 80, the first orientation is used for which the normal line direction SN of the member surface 81S of the supply member 81 is inclined at a designated angle D1 of +1 degree or more and less than +90 degrees facing from the horizontal direction H toward the antigravity direction Z side. By doing this, it is possible to seal the supply port 81K in a state with the ink injected (filled) up to the end part of the supply port 81K in the supply flow path, and there is suppression of the air (air bubbles) being left residually inside the supply flow path after the sealing process.

Though omitted with the description here, when an on-off valve mechanism controlled by opening and closing the outflow of ink to the supply port 81K is equipped, it is possible to have a state for which the supply port 81K is sealed by having the on-off valve in an open state during the processes from step S14 to step S16, and to have the on-off valve in a closed state during this step S17.

Next, at step S18 in FIG. 5, the process of sealing the opening part 99K is performed (opening sealing step). Here, the opening part 99K for which air (air bubbles) are exhausted from the ink chamber IS, the same as with sealing by the sealing member 99, is sealed by the sealing member 99*a*, and ink injected into the ink pack 80 is made not to leak out from the injection port 89.

As shown in FIG. 9, when doing the process at this step S18, the same as with the sealing process of the supply port 81K, the ink pack 80 has the first orientation by which the normal line direction SN of the member surface 81S of the supply member 81 is inclined at a designated angle D1 of +1 degree or greater and less than +90 degrees facing from the horizontal direction H to the antigravity direction Z side. By doing this, the ink inside the ink chamber IS is in a state for which it will not flow out from the opening part 99K via the injection port 89, and the opening part 99K is sealed in a state for which the ink is injected (filled) up to the injection port 89, so with the sealing process, there is suppression of having air (air bubbles) remain inside the injection port 89.

With the process of step S16, when air (air bubbles) inside the ink chamber IS remains without being exhausted from the opening part 99K via the injection port 89, when doing the process at this step S18, by deforming the pack body 91 to slightly squash it, the residual air can be discharged to the atmosphere together with a small volume of ink.

Next, at step S19 of FIG. 5, the process of inserting and housing the ink pack 80 from the opening area 71S into the first case member 71 is performed (housing step). Here, the recycler inserts the ink pack 80 in which ink is again injected into the opening area 71S of the first case member 71. At this time, the ink housed (injected) inside the pack body 91 is less than the initially housed volume, so the swelling of the pack body 91 is restricted to be small. Therefore, the ink pack 80 passed through the opening area 71S smoothly, and housing is done by inserting inside the first case member 71. In the case of a structure with the ink pack 80 attached to the second case member 72, the ink pack 80 is attached to the second case member 72 before inserting in the first case member 71. Here, at step S19, the ink pack 80 does not need to be inserted into the first case member 71 in which the ink pack 80 is originally housed, and can be inserted into another first case member 71.

Next, at step S20, the process of attaching the second case member 72 to the first case member 71 is performed (attaching step). Here, in a state with the ink pack 80 inserted from the opening area 71S to inside the first case member 71, the recycler fits in and attaches the second case member 72 to the first case member 71 so as to close the opening area 71S of the first case member 71. With the above process, the recycling process of the ink cartridge 70 ends.

With the embodiment described above, the following effects can be obtained.

(1) When injecting ink into the pack body 91, a volume of ink is injected that is lower than the initially housed volume that was initially housed in the pack body 91 of the ink pack 80 in a state housed inside the case member 73. Therefore, it is possible to again house the ink pack 80 inside the case member 73 after injecting ink into the pack body 91 outside the case member 73.

(2) For example, it is possible to take out the ink pack 80 from the opening area 71S of the first case member 71 without dismantling or dividing the first case member 71 into a plurality of members. Also, after injecting ink into the pack body 91, by inserting the ink pack 80 inside the first case member 71 from the opening area 71S, it is possible to easily house the ink pack 80 inside the case member 73.

(3) Air bubbles (air) mixed in when ink is injected, for example, are moved in the ink to the antigravity direction Z side, so it is possible to exhaust the air bubbles (air) within the detection chamber 83 via the supply port 81K positioned further to the antigravity direction Z side than the detection chamber 83 using the first orientation.

(4) Air bubbles (air) are led to the supply port 81K by the flow of ink exhausted from the supply port 81K, so it is possible to smoothly exhaust air bubbles (air) from the supply port 81K.

(5) Even when air bubbles (air) mixed in when injecting ink, for example, pool inside the detection chamber 83 with the first orientation, the air bubbles (air) pooled inside the detection chamber 83 can be exhausted to the supply port 81K using the second orientation.

(6) The supply port 81K is sealed after the air bubbles (air) within the detection chamber 83 are exhausted, so it is possible to recycle the ink cartridge 70 in a state for which it is possible for the detection chamber 83 to detect the ink volume inside the pack body 91 (residual volume).

(7) In the first orientation for which air bubbles (air) mixed in when injecting ink, for example, are exhausted from the supply port 81K, the opening part 99K is positioned further to the antigravity direction Z side than the supply port 81K, so exhausting of ink from the opening part 99K is suppressed when the ink pack 80 is in the first orientation.

(8) It is possible to reliably inject ink in the pack body 91 of a volume lower than the initially housed volume housed at the start in the pack body 91 using the information stored in the memory equipped in the ink cartridge 70 subject to again injecting ink.

The embodiment noted above can also be modified to other embodiments such as those noted below.

With the embodiment noted above, the information showing the initially housed volume of ink initially housed in the pack body 91 does not necessarily have to be stored in the memory equipped in the case member 73 of the ink cartridge 70. For example, it is also possible to have the initially housed volume of ink stored in memory such as RAM, ROM or the like of the control unit of the printer 11. In this case, the control unit of the printer 11 can read the type of mounted ink cartridge 70 from the memory equipped in the case member 73, and fetch the initially housed volume corresponding to the read type of ink cartridge 70 from the memory of the control unit.

With the embodiment noted above, the opening part 99K of the ink pack 80 for which the opening is formed at step S13 also does not absolutely have to be positioned further to the antigravity direction Z side than the supply port 81K when the ink pack 80 is in the first orientation. For example, when the probability of air bubbles (air) flowing into the pack body 91 is low when injecting ink, it is not absolutely necessary to do the process of step S15 of putting the ink pack 80 in the first orientation. Therefore, in such a case, the opening part 99K can also be in the same position as the supply port 81K in the vertical direction, or can be at a position further to the gravity direction side than the supply port 81K in the vertical direction.

With the embodiment noted above, the process of sealing the supply port at step S17 does not have to be performed after step S16, and can be performed at any timing as long as it is after step S15 (first orientation control step) and before step S19 (housing step). When the process of sealing the supply port is performed before step S16 (second orientation control step), even if there are residual air bubbles (gas) on the supply port 81K side, air bubbles (gas) do not remain in the detection chamber 83, so detection of the ink volume is performed correctly.

Alternatively, the process of sealing the supply port of step S17 can also be performed between step S19 (housing step) and step S20 (attaching step). In this case, when inserting the ink pack 80 in the first case member 71, it is preferable to have a state for which the supply port 81K is facing the antigravity direction Z side in the vertical direction so that ink does not leak out from the supply port 81K until the supply port 81K is sealed.

With the embodiment noted above, the process of step S16 of putting the ink pack 80 in the second orientation can be performed at any timing as long as it is after step S15 (first orientation control step) and before step S19 (housing step). When the process of doing second orientation control is performed after step S17, even if air bubbles (gas) that moved to the supply port 81K side remain in the supply port 81K, the air bubbles (gas) do not remain in the detection chamber 83, so detection of the ink volume can be performed correctly.

Alternatively, the process of step S16 of putting the ink pack 80 into the second orientation does not have to be performed. For example, when with the process of step S15, a flow path form is used that makes it easy for the air bubbles (air) to flow to the outflow flow path 83B from the detection chamber 83 of the ink pack 80 in the first orientation, such as by forming the outflow flow path 83B diagonally, for example, the probability of the air pocket AA2 or air bubbles AB2 remaining in the detection chamber 83 is lower. Therefore, in such a case, the process of setting the ink pack 80 to the second orientation is not necessary.

With the embodiment noted above, with the process of step S16, a portion of the ink is made to be exhausted from the supply port 81K when the ink pack 80 is set to the second orientation, but the invention is not necessarily limited to this. In short, after step S15 (first orientation control step) and before step S19 (housing step), this can be performed at any timing as long as it is before the supply port 81K is sealed.

Alternatively, it is also possible to not perform the process of exhausting a portion of the ink from the supply port 81K. For example, with the ink pack 80 in the second orientation, when movement of the air bubbles (gas) from the lead-out flow path 84 to outside the supply port 81K is performed smoothly, it is not necessary to flow ink out from the supply port 81K to exhaust air bubbles (gas). When the air bubbles (gas) supplied together with the ink to the supply needle 29 are removed (de-aerated) from the ink with the mounting unit 20, the process of flowing the ink out from the supply port 81K to exhaust the air bubbles (gas) is not necessary to begin with.

With the embodiment noted above, it is not absolutely necessary to perform the process of controlling the ink pack 80 to be in the first orientation (step S15). For example, at step S13, when forming the opening part on the pack body 91 rather than forming it on the supply member 81, the position of the opening part formed on the pack body 91 can be positioned further to the antigravity direction Z side than the supply port 81K, and an orientation can be used for which it is positioned furthest to the antigravity direction Z side in the ink chamber IS.

With the embodiment noted above, it is not absolutely necessary to have it be possible to insert and remove the ink pack 80 in the first case member 71, and to have the opening area 71S that is closed by the attached second case member 72 be formed. In this case, at step S12 (taking out step), when the first case member 71 is cut and divided into a plurality of members using a cutting tool such as a cutter or the like and the first case member 71 is formed by joining a plurality of members, the opening area is formed by undoing that joining and dismantling into a plurality of members. The ink pack 80 can be taken out from this formed opening area. In this case, at step S19 (housing step), by again joining the plurality of members that were dismantled with the ink pack 80 on the inside, the ink pack 80 is housed inside the first case member 71.

With the embodiment noted above, it is also possible to change the processes from step S14 (injection step) through step S19 (housing step). Specifically, subsequent to step S13 (opening forming step), the process of housing the ink pack 80 on which the opening part 99K is formed inside the first case member 71 is performed, and the process of injecting ink of a volume lower than the initially housed volume in the ink pack 80 housed inside the case member 73 from the opening part 99K into the pack body 91 is performed. Next, the process of sealing the opening part 99K of the ink pack 80 is performed, and the process of attaching the second case member 72 to the first case member 71 is performed.

With this processing method, when injecting ink into the pack body 91 to recycle the ink cartridge 70, it is injected into the pack body 91 of the ink pack 80 in a state housed inside the case member 73. Therefore, for the volume of ink injected for recycling, ink of a volume lower than the initially housed volume when ink was first injected and housed can be easily injected in the pack body 91 of the ink pack 80 housed inside the case member 73. Therefore, it is possible to again house the ink pack 80 in which ink is injected in the pack body 91 inside the case member 73.

With the embodiment noted above, the mounting unit 20 can also have a constitution equipped on the outside of the case 11*a* of the printer 11. When supplying ink to the liquid spray head 18 on the interior of the case 11*a* from the mounting unit 20 provided on the outside of the case 11*a*, it is necessary to lead the ink supply tube TB for supplying ink from the outside of the case 11*a* to the inside. Thus, in this case, it is preferable to provide a hole or notch in the case 11*a* in which the ink supply tube TB can be inserted. Alternatively, it is also possible to lead the ink supply tube TB through the gap provided in the case 11*a* from outside to inside the case 11*a*. By doing this, it is possible to easily perform supplying of ink to the liquid spray head 18 using the ink flow path of the ink supply tube TB.

The liquid spray head 18 is not limited to being a so-called serial head type that sprays ink by moving back and forth together with the carriage 16 in the direction crossing the conveyance direction of the paper P. Specifically, it has an overall shape for which the length size corresponds to the width size of the paper P, and in a state with the lengthwise direction fixed and arranged to go along the width direction that crosses the conveyance direction Y of the paper P, it is also possible to have an item of a so-called line head type that sprays liquid toward the medium from a plurality of nozzles provided so as to extend across roughly the entirety in the lengthwise direction.

With the embodiment noted above, the printer 11 can also be a liquid consuming device that sprays or discharges liquid other than ink. The state of the liquid discharged as tiny droplets from the liquid consuming device includes granular shapes, tear shapes, and threadlike shapes with a tail. What is referred to here as a liquid is acceptable as long as it is a material that can be sprayed by the liquid consuming device. For example, a substance when it is in a liquid state such as liquid state materials of high or low viscosity, as well as fluid bodies such as sol, gel water, other inorganic solvents, organic solvents, solutions, liquid resin, liquid metal (metal melt), and the like are included. Also, this is not limited to liquids as one physical property state, but items for which particles of functional materials consisting of a solid such as a pigment, metal particles or the like are dissolved, dispersed, or blended in a solvent and the like are also included. Representative examples of liquid or liquid body printing materials include the kind of ink like that described with the embodiments noted above, liquid crystal and the like. Here, ink includes various types of liquid body compositions such as typical water based inks and oil based inks as well as gel inks, hot melt inks and the like. As a specific example of a liquid consuming device, for example, there are liquid consuming devices which spray liquid including materials such as electrode materials or coloring materials or the like in a dispersed or dissolved form used in manufacturing items such as liquid crystal displays, EL (electro luminescence) displays, surface light emitting displays, color filters and the like. It is also possible to be a liquid consuming device for spraying bioorganic material used for biochip manufacturing, a liquid consuming device for spraying a liquid that will be a sample used for a precision pipette, a textile printing device, a micro dispenser or the like. Furthermore, it is also possible to use a liquid consuming device for spraying lubricating oil with a pinpoint on precision machines such as watches, cameras or the like, or a liquid consuming device for spraying a transparent resin liquid such a ultraviolet curing resin or the like for forming a miniature hemispheric lens (optical lens) used for optical communication elements or the like on a substrate. It can also be a liquid consuming device for spraying an acid or alkaline or the like etching fluid for etching a substrate or the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid housing container recycling method for a liquid housing container that includes a liquid housing body having a liquid housing unit that is configured to house liquid, and a supply member with a supply port that is configured to be connected to a liquid supply tube provided on a liquid consuming device, and a case member having a first case member that houses the liquid housing body, and a second case member that is attached to the first case member in a state with the supply port being exposed, the liquid housing container recycling method comprising:

removing the second case member from the first case member;

taking out the liquid housing body from inside of the first case member;

forming an opening part that communicates with inside of the liquid housing unit, the opening part being formed in an injection port which has been sealed by fusion of the supply member after injecting liquid into the inside of the liquid housing unit from outside;

injecting into the inside of the liquid housing unit from the opening part that has been formed the liquid of a volume that is smaller than an initially housed volume when the liquid is initially injected and housed in the liquid housing unit of the liquid housing body in a state of being housed inside the case member, the injecting being performed in a state in which the second case member is removed from the first case member and the liquid housing body is taken out from inside of the first case member, and the liquid being injected to recycle the liquid housing container in the injecting;

sealing the opening part of the liquid housing body;

housing inside the first case member the liquid housing body for which the opening part is sealed; and attaching the second case member to the first case member.

2. The liquid housing container recycling method according to claim 1, wherein the first case member has an opening area through which the liquid housing body is insertable and removable, and that is closed by the second case member, the taking out of the liquid housing body includes taking out the liquid housing body from the first case member via the opening area, and the housing of the liquid housing body includes inserting and housing the liquid housing body for which the opening part is sealed inside the first case member from the opening area.

3. The liquid housing container recycling method according to claim 1, wherein the supply member has a supply flow path in which the liquid flows from the liquid housing unit to the supply port, with the supply flow path having a detection chamber that is configured to detect a volume of the liquid inside the liquid housing unit on the same side surface as a member surface on which the supply port is formed, the liquid housing container recycling method further comprising setting the liquid housing body to a first orientation in which the supply port is at a position further to the antigravity direction side in a vertical direction than the detection chamber, and in which a normal line direction of the member surface is inclined at an angle of +1 degree or more and less than +90 degrees from a horizontal direction facing the antigravity direction side during the injecting of the liquid, or after the injecting of the liquid and before the housing of the liquid housing body.

4. The liquid housing container recycling method according to claim 3, wherein a portion of the injected liquid is exhausted from the supply port after the setting of the liquid housing body to the first orientation and before the housing of the liquid housing body.

5. The liquid housing container recycling method according to claim 3, further comprising setting the liquid housing body to a second orientation in which the opening part is at a position further to the antigravity direction side in the vertical direction than the supply port, and in which the normal line direction of the member surface is inclined at an angle of −45 degrees or greater and less than +1 degree from the horizontal direction facing the antigravity direction side after the setting of the liquid housing body to the first orientation and before the housing of the liquid housing body.

6. The liquid housing container recycling method according to claim 3, further comprising sealing the supply port after the setting of the liquid housing body to the first orientation and before the housing of the liquid housing body.

7. The liquid housing container recycling method according to claim 3, wherein the opening part of the liquid housing body is positioned further to the antigravity direction side than the supply port when the liquid housing body is put in the first orientation during the opening of the opening part.

8. A liquid housing container recycled by the liquid housing container recycling method according to claim 1.

9. A liquid housing container comprising:

a liquid housing body having a liquid housing unit that is configured to house liquid, and a supply member with a supply port that is configured to be connected to a liquid supply tube provided on a liquid consuming device; and a case member having a first case member that houses the liquid housing body and has an opening area through which the liquid housing body is insertable and removable, and a second case member that is attached to the first case member in a state with the supply port being exposed to close the opening area, the liquid housing body being configured to house the liquid of a volume that is smaller than an initially housed volume of the liquid when the liquid is initially injected into the liquid housing unit of the liquid housing body in a state of being housed inside the case member, and the liquid being injected in a state in which the second case member is removed from the first case member and the liquid housing body is taken out from inside of the first case member, and the liquid being injected to recycle the liquid housing container.

10. The liquid housing container according to claim 9, further comprising a memory provided to the case member and configured to store information indicating the initially housed volume of the liquid that is initially housed in the liquid housing unit.

11. A liquid housing container recycling method for a liquid housing container that includes a liquid housing body having a liquid housing unit that is configured to house liquid, and a supply member with a supply port that is configured to be connected to a liquid supply tube provided on a liquid consuming device, and a case member having a first case member that houses the liquid housing body, and a second case member that is attached to the first case member in a state with the supply port being exposed, the liquid housing container recycling method comprising;

removing the second case member from the first case member;

taking out the liquid housing body from inside of the first case member;

forming on the liquid housing body an opening part that communicates with the inside of the liquid housing unit, the forming being performed in a state in which the second case member is removed from the first case member and the liquid housing body is taken out from inside of the first case member;

housing the liquid housing body on which the opening part is formed inside the first case member;

injecting into the inside of the liquid housing unit from the opening part that has been formed the liquid of a volume that is smaller than an initially housed volume of the liquid when the liquid is initially injected and housed in the liquid housing unit of the liquid housing body in a state of being housed inside the case member, and the liquid being injected to recycle the liquid housing container in the injecting;

sealing the opening part of the liquid housing body; and attaching the second case member to the first case member.

* * * * *